US009525242B1

(12) United States Patent
Lou et al.

(10) Patent No.: US 9,525,242 B1
(45) Date of Patent: Dec. 20, 2016

(54) MODULAR CONNECTORS WITH ELECTROMAGNETIC INTERFERENCE SUPPRESSION

(71) Applicant: Cisco Technology, Inc., San Jose, CA (US)

(72) Inventors: Jianquan Lou, Shanghai (CN); Hongmei Fan, Shanghai (CN); Quanhui Sun, Shanghai (CN); Shun Li, Shanghai (CN); Alpesh U. Bhobe, Sunnyvale, CA (US); Jinghan Yu, Shanghai (CN); Yingchun Shu, Shanghai (CN)

(73) Assignee: Cisco Technology, Inc., San Jose, CA (US)

( * ) Notice: Subject to any disclaimer, the term of this patent is extended or adjusted under 35 U.S.C. 154(b) by 0 days.

(21) Appl. No.: 14/833,395

(22) Filed: Aug. 24, 2015

(51) Int. Cl.
*H01R 13/6585* (2011.01)
*H01R 13/66* (2006.01)
*H01R 43/20* (2006.01)

(52) U.S. Cl.
CPC ..... *H01R 13/6585* (2013.01); *H01R 13/665* (2013.01); *H01R 13/6633* (2013.01); *H01R 43/205* (2013.01)

(58) Field of Classification Search
CPC ..... H01R 13/7193; H01R 13/7195; H01R 13/7197
See application file for complete search history.

(56) References Cited

U.S. PATENT DOCUMENTS 4,772,224 A * 9/1988 Talend ..... H01R 13/7195 439/607.28
5,069,641 A 12/1991 Sakamoto et al.
5,397,250 A * 3/1995 Briones ..... H01R 13/7195 439/607.01
5,456,619 A * 10/1995 Belopolsky ..... H01R 13/7197 439/620.07
5,587,884 A * 12/1996 Raman ..... H01R 13/665 333/182
5,823,827 A * 10/1998 Belopolsky ..... H01R 13/6658 439/620.06

(Continued)

FOREIGN PATENT DOCUMENTS

JP 2002094281 A 3/2002

OTHER PUBLICATIONS

"Ferrite Bead Installation for 50 Hz Operation", Power Xpert Meter 2000, PE02601081E, PXM2250, PXM2260, PXM2270, PXM2280, PXM2290, Effective Jan. 2012, Eaton Corporation, Publication No. PE02601081E, Jan. 2012, 2 pages.

(Continued)

*Primary Examiner* — Ross Gushi
(74) *Attorney, Agent, or Firm* — Edell, Shapiro & Finnan, LLC

(57) ABSTRACT

Presented herein is a modular connector with electromagnetic interference suppression. The modular connector includes a substrate, at least one set of spring pins, and a ferrite component. Each spring in the at least one set of springs includes a first portion adjacent the substrate and a second portion extending away from the substrate. The ferrite component surrounds the at least one set of spring pins, couples the at least one set of spring pins to the substrate, and is configured to suppress electromagnetic interference.

19 Claims, 8 Drawing Sheets

(56) References Cited

U.S. PATENT DOCUMENTS 5,872,492 A * 2/1999 Boutros ..... H01R 13/719 333/182
5,971,805 A * 10/1999 Belopolsky ..... H01R 13/719 439/620.17
6,062,908 A 5/2000 Jones
6,102,741 A * 8/2000 Boutros ..... H01R 13/6633 336/107
6,159,050 A * 12/2000 Belopolsky ..... H01R 13/719 439/620.15
6,171,152 B1 * 1/2001 Kunz ..... H01R 24/64 439/620.18
6,227,911 B1 * 5/2001 Boutros ..... H01R 13/719 439/490
6,238,247 B1 * 5/2001 Belopolsky ..... H01R 13/65802 439/620.18
6,276,968 B1 * 8/2001 Belopolsky ..... H01R 13/719 439/620.18
6,302,741 B1 10/2001 Fasold et al.
6,579,116 B2 * 6/2003 Brennan ..... H01R 13/6461 439/418
6,612,871 B1 * 9/2003 Givens ..... H01R 13/7193 439/620.17
6,881,096 B2 * 4/2005 Brown ..... H01R 31/06 439/620.01
6,918,791 B2 * 7/2005 Wan ..... H01R 24/64 439/607.01
7,018,242 B2 * 3/2006 Brown ..... H01R 31/06 439/676
7,530,854 B2 5/2009 Aekins
7,749,027 B2 * 7/2010 Chow ..... H01R 13/6658 439/620.06
7,914,331 B2 3/2011 Hetzer et al.
8,147,278 B2 * 4/2012 Renteria ..... H01R 13/6658 439/676
8,203,418 B2 * 6/2012 Harrison ..... H01F 19/04 336/192
8,449,332 B2 * 5/2013 Purkis ..... H01R 24/64 439/620.06
8,545,274 B2 * 10/2013 Purkis ..... H01R 13/719 439/668
8,764,493 B2 * 7/2014 Renteria ..... H01R 13/6658 439/676
8,888,538 B2 * 11/2014 Regnier ..... H01R 12/724 439/540.1
8,968,026 B2 * 3/2015 Gailus ..... H01R 13/6633 439/620.05
8,992,248 B2 * 3/2015 O'Malley ..... H01R 13/6469 439/541.5
9,077,120 B2 * 7/2015 Zhang ..... H01R 13/6658
9,130,315 B2 * 9/2015 O'Malley ..... H01R 13/6469
9,209,581 B2 * 12/2015 O'Malley ..... H01R 13/6469
2003/0211782 A1 * 11/2003 Esparaz ..... H01R 13/6658 439/620.11
2006/0128228 A1 * 6/2006 Wan ..... H01R 24/64 439/676
2006/0246784 A1 * 11/2006 Aekins ..... H01R 4/2433 439/676
2007/0015416 A1 * 1/2007 Gutierrez ..... H01R 24/64 439/676
2011/0053418 A1 * 3/2011 Margulis ..... H01R 13/719 439/620.07
2012/0309233 A1 12/2012 O'Malley et al.
2013/0171874 A1 * 7/2013 Wei ..... H01R 13/6658 439/620.1
2014/0349520 A1 * 11/2014 Aizawa ..... H01R 13/6588 439/607.12
2014/0377996 A1 * 12/2014 Renteria ..... H01R 13/6658 439/620.21
2015/0011131 A1 * 1/2015 Zhou ..... H01R 13/518 439/694
2016/0056596 A1 * 2/2016 Gao ..... H01R 24/64 439/38

OTHER PUBLICATIONS

"Automotive Multi-Hole Ferrite Plate for Connectors", 29D0992-000-Multi-Hole Ferrite Plates, 29D0992-000-Auto, LairdTech, http://www.lairdtech.com/products/29d0992-000-auto, retrieved from Internet on Aug. 24, 2015, 2 pages.

* cited by examiner

MODULAR CONNECTORS WITH ELECTROMAGNETIC INTERFERENCE SUPPRESSION

TECHNICAL FIELD

The present disclosure relates to modular connectors and, in particular, to modular connectors with electromagnetic interference ("EMI") suppression.

BACKGROUND

Modular connectors are often provided in an array or arrangement to provide multiple connections to the same electronic device. For example, a modular jack may include a 2×8 array of modular connectors, such that the jack has 8 columns and each column has a pair of stacked connectors including an upper port or cell and a lower port or cell. For efficiency, hardware extending into the upper and lower ports may be disposed between the ports. In other words, a single substrate with spring pins included on opposite planar sides (i.e., a first side and a second side that are opposite each other) may be included between two stacked ports and arranged so that the spring pins on a first side of the substrate extend into one of the upper or lower port and the spring pins on a second side of the substrate extend into the other. Generally, the spring pins are configured to removably secure cables, including shielded and unshielded twisted pair cabling, within a port while electrically coupling the cable to a device the connector is installed or included on. The spring pins may be mounted or coupled to the substrate with plastic that may fixedly or rotatably coupled to the substrate.

Modular connectors are widely used for a variety of application and are most prominently used as Ethernet and telephone jacks. However, in some instances, such as when unshielded twisted pair ("UTP") cables are connected to electronic products via modular connectors, modular connectors experience problems with electromagnetic compatibility. For example, electromagnetic noise in the electronic product may be emitted from the modular connector and radiate from the cable. Additionally or alternatively, electromagnetic noise outside of the product may couple into the cable, enter the product via the modular jack and impact immunity of product.

DESCRIPTION OF EXAMPLE EMBODIMENTS

Overview

Figure 1:
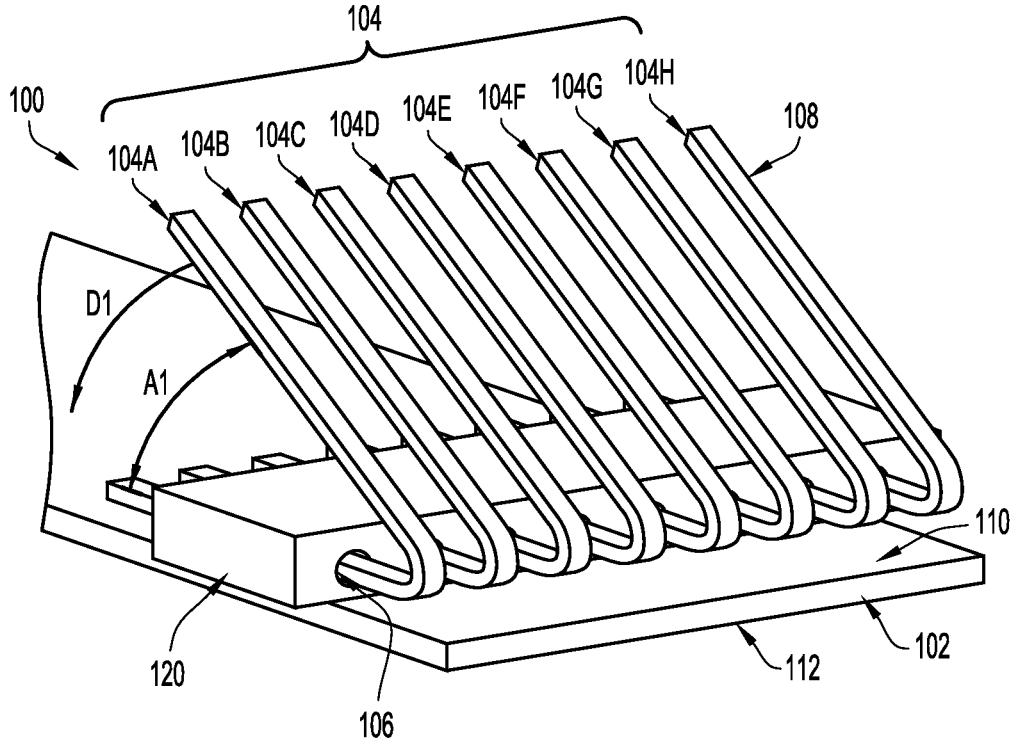
FIG. 1 is a perspective view of a modular connector with EMI suppression, according to a first example embodiment.

Presented herein is a modular connector with EMI suppression, an EMI suppression system for a modular jack, and a method of suppressing electromagnetic interference in a modular jack. According to one example embodiment, a modular connector includes a substrate, at least one set of spring pins, and a ferrite component. Each spring pin included in the at least one set of spring pins includes a first portion adjacent the substrate and a second portion extending away from the substrate. The ferrite component surrounds the at least one set of spring pins, couples the at least one set of spring pins to the substrate, and is configured to suppress electromagnetic interference.

According to another example embodiment, a system includes a modular jack including at least one set of spring pins and a ferrite component configured to be installed around the spring pins. The modular jack includes a cable side configured to receive a cable and the ferrite component is installed on the cable side of the modular jack and is configured to suppress electromagnetic noise generated by a transformer included in the modular jack and electromagnetic noise from the cable.

According to another example embodiment, a method of suppressing electromagnetic interference in a modular jack includes providing a ferrite component, and installing the ferrite component around a set of spring pins included in a cell of a modular jack. The ferrite component is installed on a cable side of the modular jack, and is configured to suppress electromagnetic noise generated by a transformer included in the modular jack and electromagnetic noise from a cable that is coupled to the modular jack when installed.

Example Embodiments

Presented herein are innovative connectors with EMI suppression, systems for EMI suppression, and methods for installing the systems. In some embodiments, the connectors or systems described herein may replace connectors included in a modular jack; however, in other embodiments, the systems and methods for EMI suppression may be utilized to retrofit or otherwise modify existing connectors. For ease of illustration, connectors and systems in accordance with the examples presented herein are described with reference to a single port, connector, or stack/column of ports. However, the connectors and systems shown herein may be incorporated, included, or expanded to include or provide any desirable number of modular connector ports, including a single port of a modular jack, 1×N ports, and stacked modular jacks (2×N ports). Moreover, the presented embodiments may be suitable for any data rate cases such as 10M, 100M, 1000M, 10G and 40G and may be configured or reconfigured for various footprints of various cable connectors, such as various RJ45 connector footprints. Methods for suppressing EMI described herein may also be described with reference to a single port, connector, or stack/column of ports, but may also be utilized with any number of ports for any data rate cases and any desirable cable footprint.

Additionally, for ease of description, terms such as "left," "right," "top," "bottom," "front," "rear," "side," "height," "length," "width," "upper," "lower," "interior," "exterior," "inner," "outer," "forward," "rearward," "upwards," "downwards," and the like as may be used herein, but merely describe points or portions of reference and do not limit the examples presented to any particular orientation or configuration. Further, terms such as "first," "second," "third," etc., merely identify one of a number of portions, components and/or points of reference as disclosed herein, and do not limit the examples presented herein to any particular configuration or orientation.

Referring to FIGS. 1-13, examples of a connector, system, and a method for suppressing EMI according to example embodiments are illustrated. Generally, the connector, system, and method provide a ferrite component that surrounds a set of spring pins. As is explained in detail below, in the depicted embodiments the ferrite component is an annular or ring-like component and is installed on the cable side of a modular connector (as opposed to the chip side). In some embodiments, the ferrite component directly receives the spring pins, but in other embodiments, the ferrite component is configured to receive an insert that can receive the spring pins. Regardless, installing the ferrite component in a connector in the manner described herein may suppress or reduce EMI in order to resolve emission and immunity problems without negatively impacting transmission or requiring any part or portion of a typical modular connector to be modified. Moreover, due at least to the fact that the ferrite component is disposed on the cable side of a modular connector, the ferrite component may suppress electromagnetic noise generated by components of a modular jack, such as a transformer.

Figure 2:
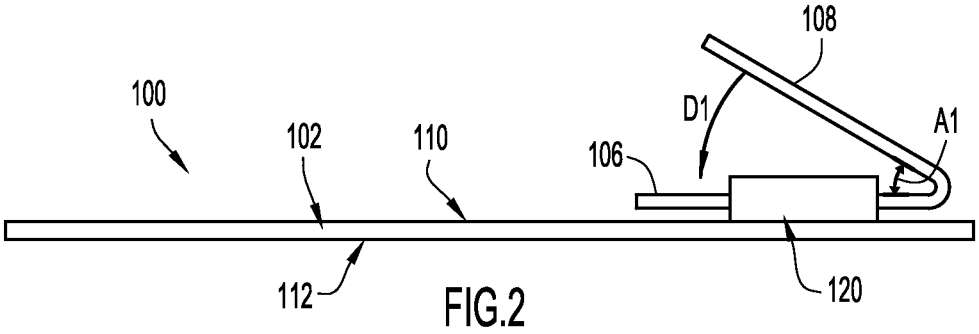
FIG. 2 is a side view of the modular connector of FIG. 1.
Figure 3:
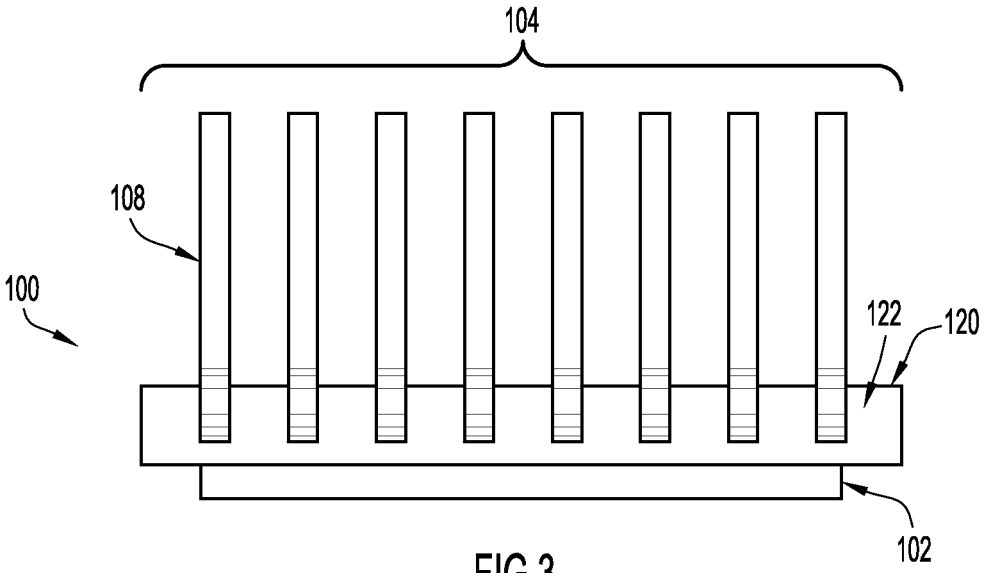
FIG. 3 is a front view of the modular connector of FIG. 1.

Referring to FIGS. 1-3, an example embodiment of a connector 100 is shown from perspective, side, and front views, respectively. The connector 100 includes a substrate 102 and a set of spring pins 104 including pins 104A-H. Each pin 104A-H in the set of pins 104 includes a first portion 106, which may also be referred to as base portion 106, and a second portion 108, which may also be referred to as spring portion 108. The spring portion 108 is configured to extend away from the base portion 106 at an angle A1 above the base portion 106 such that the spring portion may extend into a port or cell of a modular connector disposed adjacent (i.e., above or below) the substrate 102 to engage contacts included on a cable disposed within or inserted into the port. The spring portion 108 is typically resilient, flexible, or otherwise movable in the direction indicated by arrow D1 towards the base portion 106. Consequently, the set of pins 104 may be configured to resiliently receive any cables inserted into a port of the connector 100 and maintain a connection therewith. Meanwhile, the base portion 106 of the pins included in the set of pins 104 is coupled to a first planar surface 110 of the substrate 102 via a ferrite component 120. However, as mentioned, this configuration is merely exemplary and in other embodiments, the set of pins 104 could be coupled to the substrate 102 via the ferrite component 120 along another planar surface, such as surface 112.

Figure 4:
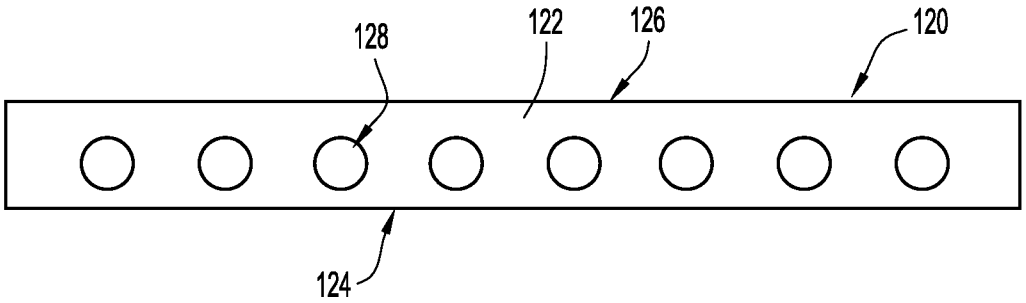
FIG. 4 is a front view of a ferrite component included in the modular connector of FIG. 1.

With further reference to FIG. 4, in the depicted embodiment, the ferrite component 120 is a substantially cuboidal component and includes a body or elongate member 122 with a bottom 124 and a top 126. In this embodiment, the bottom 124 is coupled to the first planar surface 110 of the substrate and the top 126 is substantially parallel to the bottom 124. Additionally, the ferrite component 120 includes apertures 128 extending through the body 122 parallel to at least the bottom 124 of the ferrite component 120. Each aperture 128 is configured to receive one of the pins 104A-H included in the set of pins 104. As is discussed below in detail, in some embodiments, the ferrite component 120 may include an aperture or apertures configured to receive more than one pin 104A-H. In some of these embodiments, the ferrite component 120 may also include subapertures formed within an aperture or apertures in order to separately receive each pin 104A-H. It is to be understood that apertures 128 or any other aperture which may receive a subset of pins 104A-H (i.e., a single spring pin 104A-H) may be referred to as a subaperture. In other words, apertures 128 may be considered subapertures.

Still referring to FIGS. 1-4, since the apertures 128 are disposed within the body 122 and spaced a distance from the top 126 and bottom 124 of the ferrite component, the base portion 106 of each pin 104 is maintained a slight distance above the substrate 102, as best shown in FIG. 2. Moreover, at least because the top 126 of the ferrite component is a distance above the apertures 128, if the spring portion 108 of a pin 104A-H is moved or bent in accordance with arrow D1, the ferrite component 120 may prevent the spring portion 108 from being moved into contact with the base portion 106. For example, in some embodiments, the distal ends of spring portion 108 (e.g., the excitation ports) may be maintained at a distance, such as 3.5 mm, above the distal ends (e.g., the excitation ports) of base portion 106. The distance between the base portion 106 and spring portion 108, as well as the size of the pins 104A-H may result in an impedance of more than 100,000 ohm in the ferrite target frequency (<1 GHz) and, thus, any coupling between the spring portion 108 and base portion 106 can be ignored. For example, since Capacitance=($\epsilon$*A)/d, where $\epsilon$ is the electric constant of $8.854\times10^{-12}$ F, A is the area of overlap of two conductors, and d is the separation between the conductors, the capacitance will be merely 0.001 pF in embodiments where A is approximately 0.4 mm×1 mm (i.e., $0.4\times10^{-6}$ $m^2$) and d is approximately 3.5 mm (i.e., $3.5\times10^{-3}$m), which results in an impedance of over 100,000 ohm.

Figure 5:
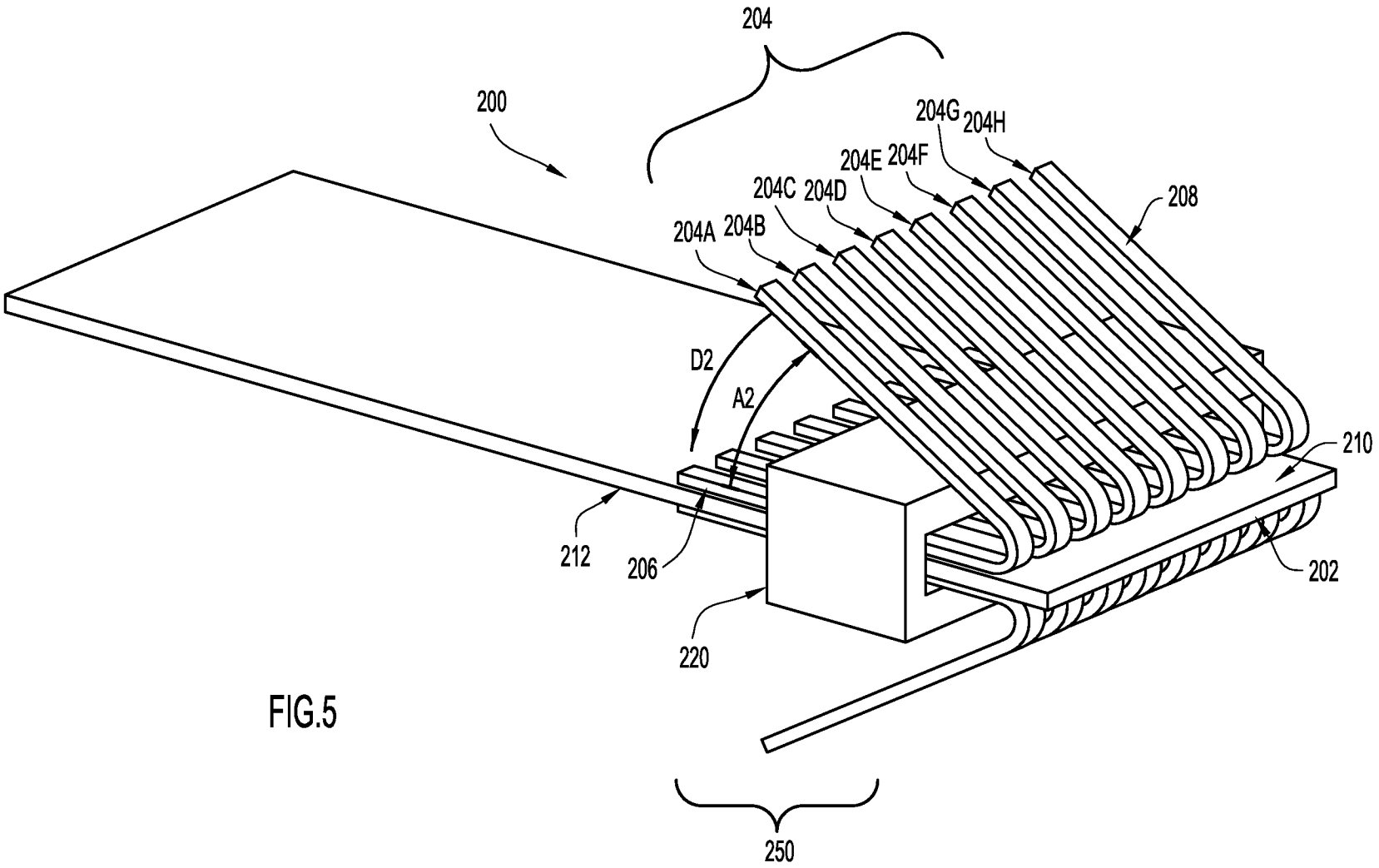
FIG. 5 is a perspective view of a modular connector with EMI suppression, according to a second example embodiment.
Figure 6:
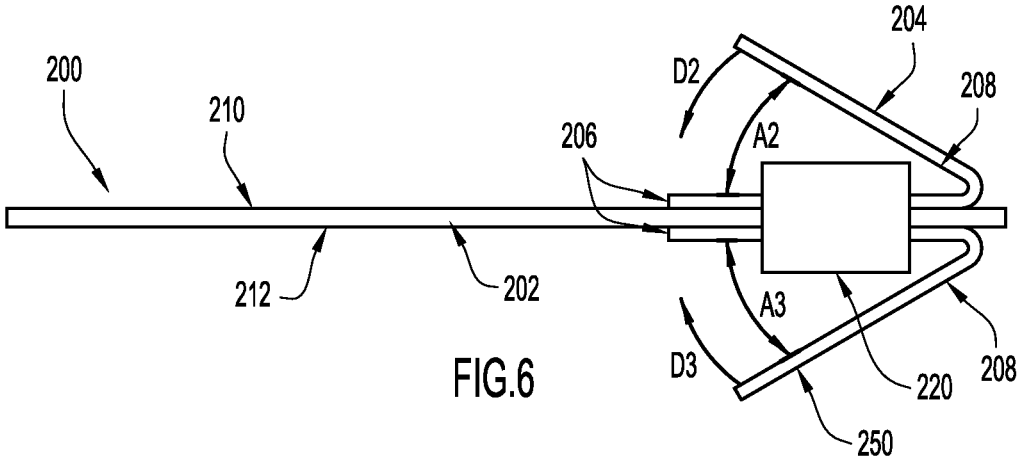
FIG. 6 is a side view of the modular connector of FIG. 5.
Figure 7:
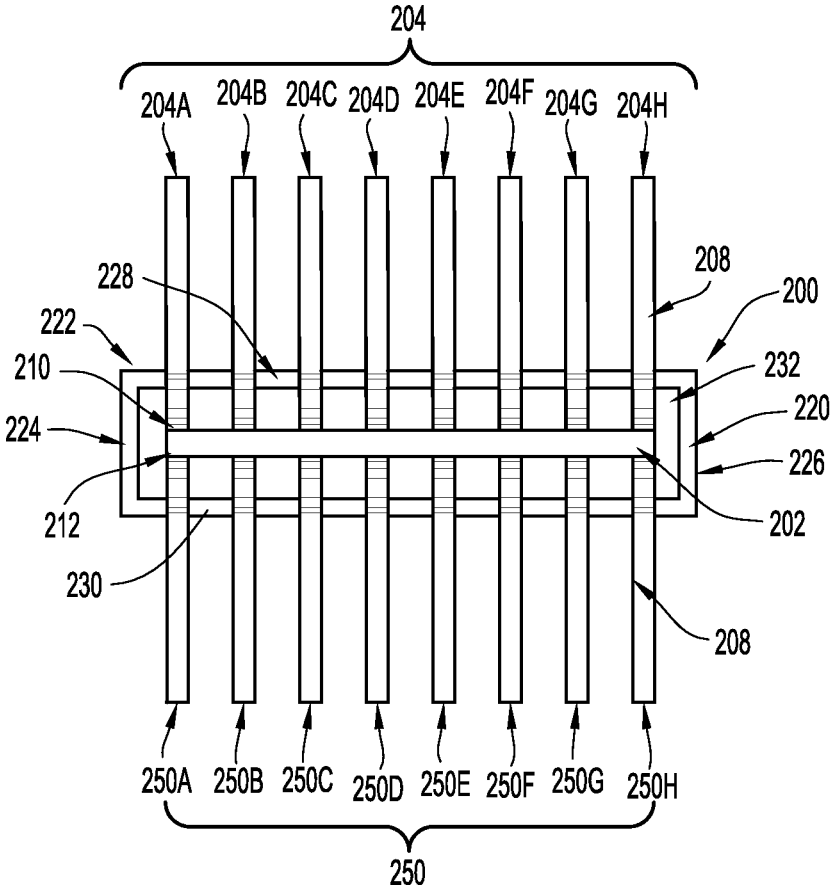
FIG. 7 is a front view of the modular connector of FIG. 5.

Now referring to FIGS. 5-7, another embodiment of a connector 200 is shown from perspective, side, and front views, respectively. Connector 200 is configured to provide electrical connections for a column of two ports. Thus, in contrast with connector 100, connector 200 includes a first set of spring pins 204, including pins 204A-H and a second set of spring pins 250 including pins 250A-H. Each of pins 204A-H and 205A-H includes a base portion 206 and a spring portion 208. The base portions 206 of the pins 204A-H are coupled to a first surface 210 of the substrate 202 and the base portions 206 of the pins 250A-H are coupled to a second surface 212 of the substrate that is opposite the first surface 210. The spring portions 208 of the pins 204A-H in the first set 204 extend away from surface 210 at an angle A2 and are resiliently coupled to their respective base portion 206 so that the spring portion may move or flex in the direction indicated by arrow D2. Similarly, as shown best in FIG. 6, the pins 250A-H in the second set 250 extend away from surface 212 at an angle A3 and are resiliently coupled to their respective base portion 206 so that the spring portion 208 may move or flex in the direction indicated by arrow D3. In other words, the spring portions 208 of the pins 204A-H and 250A-H are configured to resiliently flex towards the substrate 202 to, for example, resiliently receive and secure a cable being inserted into the modular connector 200.

As mentioned, in some embodiments, spring pins may be coupled directly to a substrate, but in other embodiments, spring pins may be coupled to a substrate via a ferrite connector, as shown in FIGS. 1-4. Additionally, or alternatively, the spring pins may be coupled to the substrate via a plastic or non-ferrite connector. In the embodiment shown in FIGS. 5-7, the first set of pins 204 is coupled directly to the first side 210 of the substrate 202, the second set of pins 250 is coupled to the second side 212, and a ferrite component 220 extends around the substrate 202 and the base portions 206 of each the pins 204A-H and 250A-H included in the first and second sets 204, 250. However, in other embodiments, the pins 204A-H and 250A-H may be coupled to the substrate 202 via a plastic connector and the ferrite component 220 may surround the pins 204A-H, 250A-H, the substrate 202, and any plastic connectors.

Figure 8:
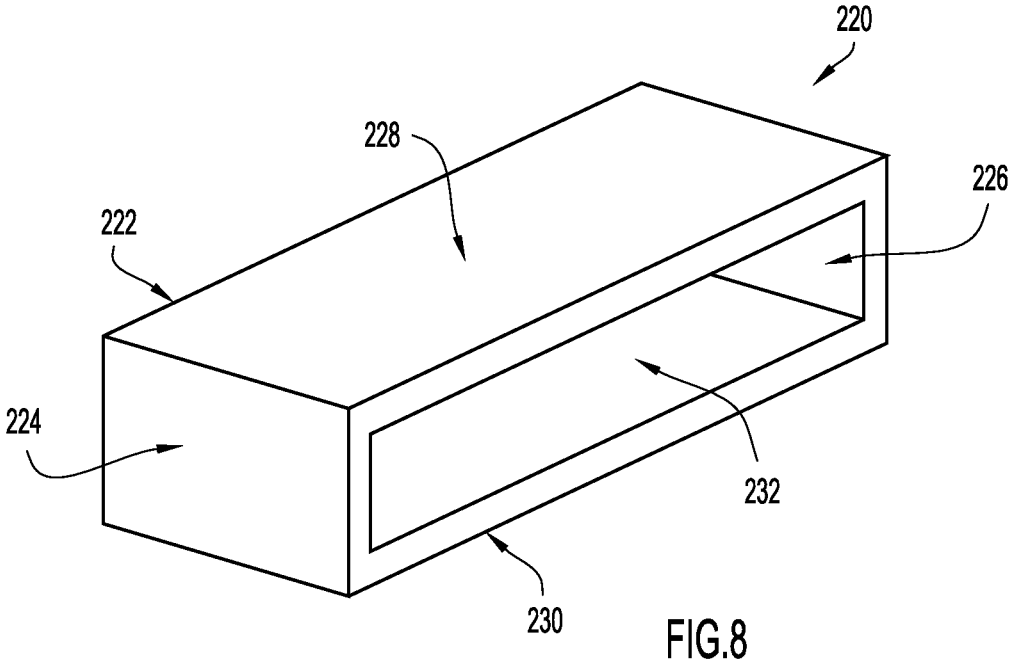
FIG. 8 is a side perspective view of a ferrite component included in the modular connector of FIG. 5.
Figure 9:
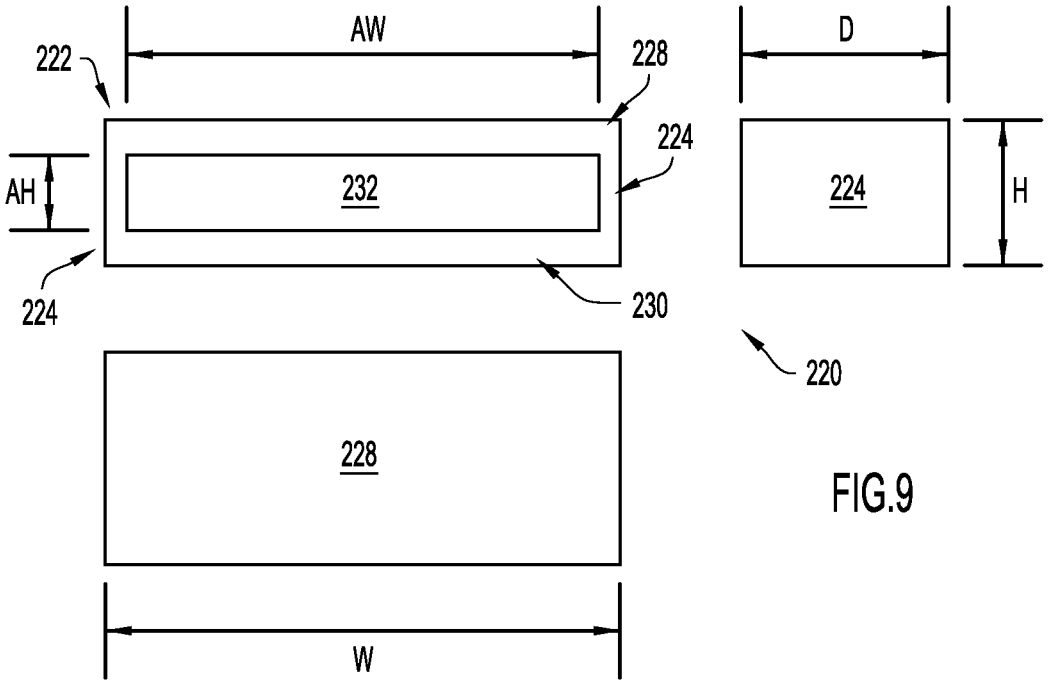
FIG. 9 is an isometric view of the ferrite component of FIG. 8.

Referring now to FIGS. 8 and 9, with continued reference to FIGS. 1-7, the ferrite component 220 includes an annular body or wall 222 that includes a first side 224, a second side 226, a top 228, and a bottom 230 that collectively extend around an aperture 232. In this embodiment, the ferrite component 220 is a rectangular annular component, such that the top 228 and bottom 230 extend between the first side 224 and the second side 226, the top 228 extends over the base portions 206 of the first set of springs 204, and the bottom 230 extends over the base portions 206 of the second set of springs 250. In particular, and as shown in FIG. 9, in this embodiment, the ferrite component 220 is a rectangular component with an outer width W of approximately 12.44 mm, an outer height H of approximately 3.3 mm, and an outer depth D of approximately 4.5 mm. The ferrite component also includes an inner aperture with a height AH of approximately 1.7 mm and a width of approximately 11.44 mm, such that the sides 224 and 226 of the ferrite component have a width of approximately 1 mm (e.g., 12.44 mm-11.44 mm) while the top 228 and bottom have a width of approximately 1.6 mm (e.g., 3.3 mm-1.7 mm). A ferrite ring 220 with the aforementioned approximate dimensions may have a relative permeability of approximately 1000, which may provide suitable EMI suppression. However, the shape and sizes of the ferrite component, as well as the sizes of the walls of the ferrite component, are not intended to be limiting and, in other embodiments, the ferrite component 220, as well as the other embodiments of ferrite components described herein, may be shaped and sized as desired.

Figure 10:
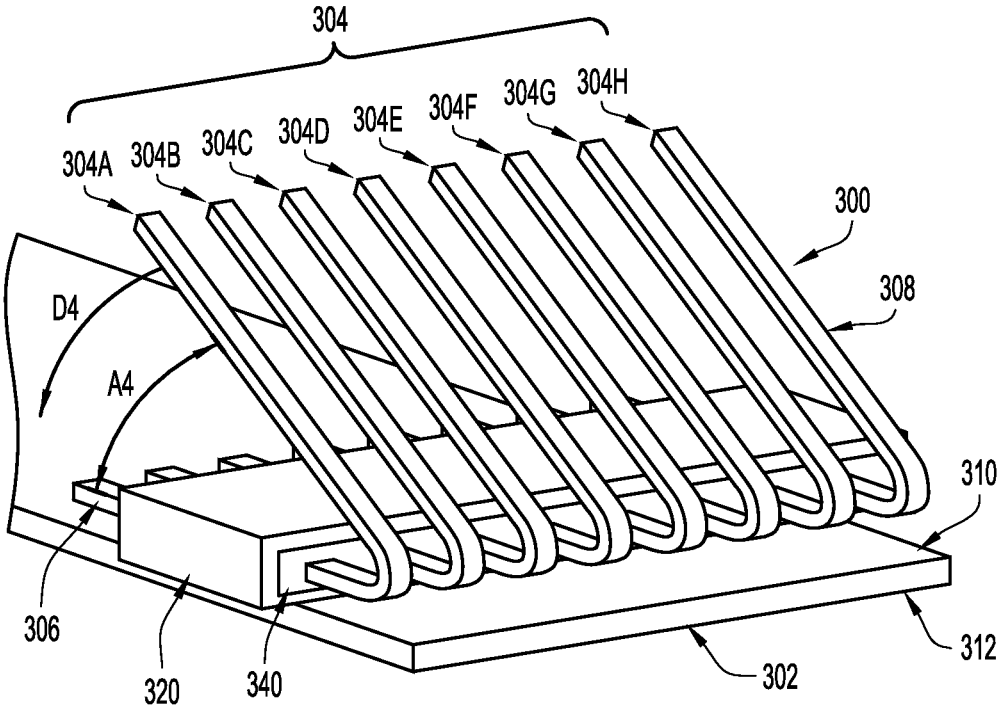
FIG. 10 is a side perspective view of a modular connector with EMI suppression, according to a third example embodiment.
Figure 11:
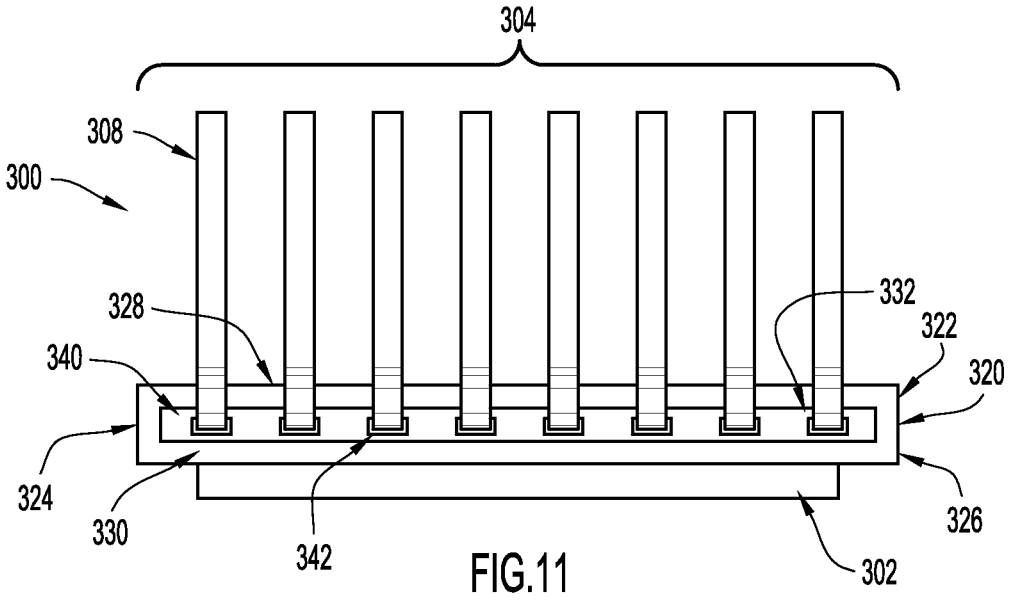
FIG. 11 is a front view of the modular connector of FIG. 10.

Now referring to FIGS. 10 and 11, a third embodiment of a modular connector 300 is shown from a perspective and front view. Similar to connector 100, connector 300 only includes a first set of spring pins 304, including pins 304A-H and, again, each of the pins 304A-H includes a base portion 306 coupled to a first surface 310 of a substrate and a spring portion 308 that extends away from the base portion 306 at an angle A4. Moreover, the spring portions 308 of the pins 304A-H are again configured to resiliently flex towards the substrate 302 in the direction indicated by arrow D4 to, for example, resiliently receive and secure a cable being inserted into the modular connector 300. However, in contrast with connector 100, the pins 304A-H of connector 300 are coupled to the substrate 302 via a ferrite component 320 that includes an insert 340.

More specifically, and as shown in FIG. 11, although the ferrite component 320 is similar to the ferrite component 120 of connector 100 insofar as the ferrite component 320 includes an annular wall 322 with a first side 324, a second side 326, a top 328, and a bottom 330 that collectively surround the base portions 306 of the first set of spring pins 304 and couple the first set of spring pins 304 to the substrate 302, the ferrite component 320 does not independently receive each of the spring pins 304A-H like the ferrite component 120 does. Instead, the ferrite component 320 includes an aperture 332 that is configured to receive an insert 340 that includes subapertures 342 and each of the subapertures 342 are configured to receive a single spring pin 304A-H. In some embodiments, the insert 340 may be a plastic insert and, together, the ferrite ring 320 and insert 340 may act as a common noise filter. Moreover, in some embodiments, the insert 340 may not actually be inserted into the ferrite component 320, despite the nomenclature used to describe this part. Instead, as mentioned above, in some embodiments, the spring pins 304A-H of a standard connector may be coupled, perhaps rotatably, to the substrate 302 with a plastic piece or portion (the insert 340) and the ferrite component 320 may be installed around the preexisting plastic insert 340. In other words, in some embodiments, the ferrite component 320 may be retrofit around a plastic connector (insert 340) included on a modular connector.

Still referring to FIGS. 10 and 11 but with reference back to FIGS. 5-7, although the connector 300 is only shown to include a single set of spring pins 304A-H, it is to be understood that the aperture and subaperture configuration (e.g., the ferrite component and insert configuration) shown in FIGS. 10 and 11, may be also be utilized with connectors or substrates that include a pair of spring pins. For example, in the embodiment shown in FIGS. 5-7, an insert or a pair of inserts could be included in the connector 200 and the ferrite component 220 could surround the base portions 206 of both sets of pins 204, 250, the substrate 202, and any and all inserts included therein. In some embodiments, a single insert may surround the substrate 202 and couple both sets of pins 204, 250 to the substrate while in other configurations a pair of inserts may be included in connector 200 in order to individually couple each set of pins 204, 250 to the substrate 202. Regardless of the arrangement, the ferrite component and any combination of inserts may provide EMI suppression.

Figure 12:
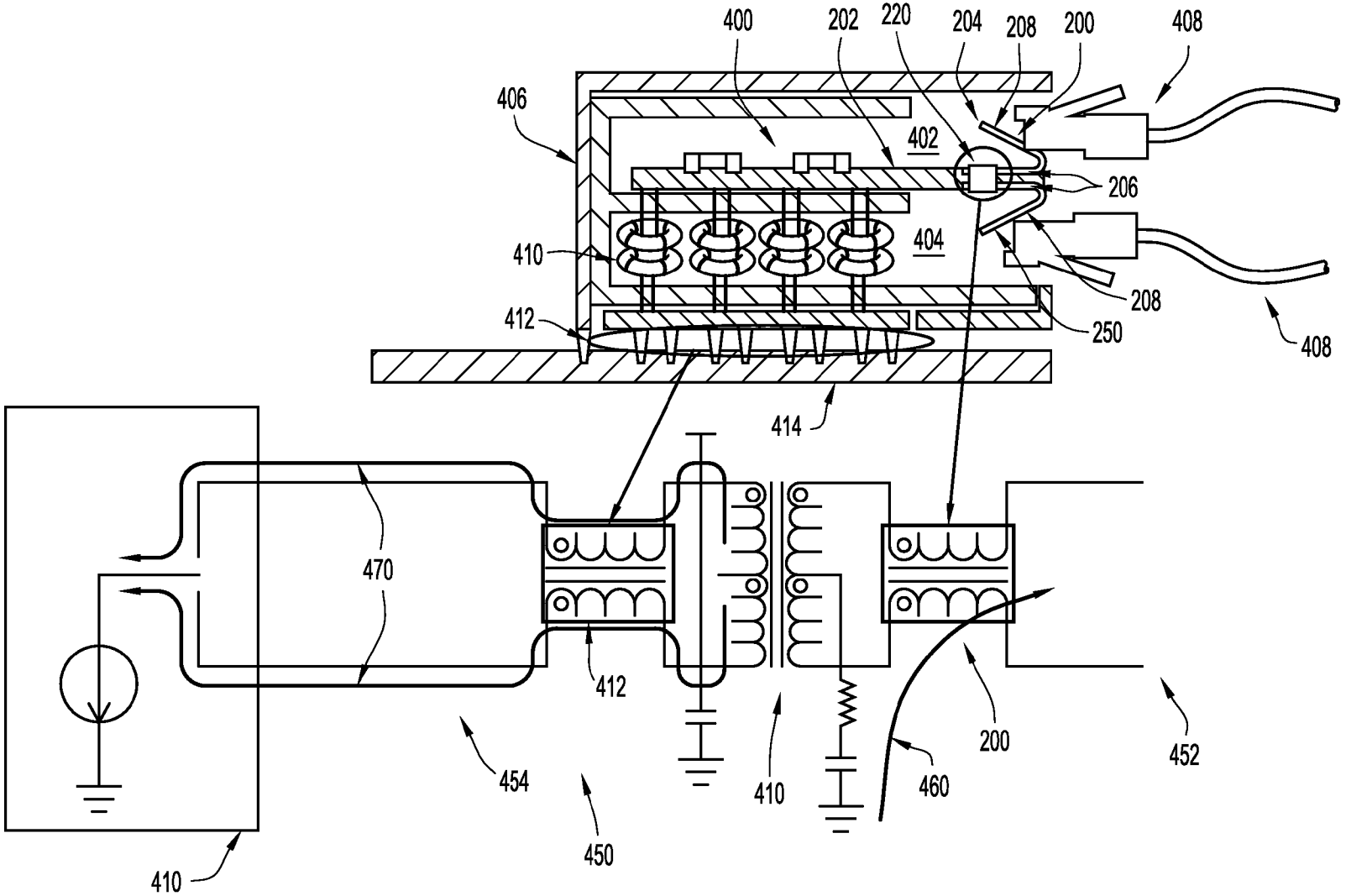
FIG. 12 provides a combined sectional view and representative schematic diagram of a modular jack including a modular connector with EMI suppression according to an example embodiment.

Now referring to FIG. 12 a sectional view of a modular jack 400 including connector 200 is shown together with a schematic diagram representation 450 of the jack 400. As mentioned above, when the connector 200 is installed, the spring portions 208 of the first and second sets of spring pins 204, 250 extend into the upper and lower ports 402, 404 included in a column 406 and, thus, are configured to receive and eclectically couple cables 408 to an electronic device attached to the modular jack. In other words, and as shown best in the schematic diagram 450 included in FIG. 12, the connector 200, including the ferrite component 220, is disposed on a cable side 452 of the modular jack 400. Due at least to the fact that the ferrite component is disposed on the cable side 452 of the modular jack 400, the ferrite component 220 is disposed between cables 408 inserted into the jack 400 and a transformer 410 included in the modular jack 400. Consequently, the ferrite component 220 may serve to attenuate any common mode noise, as represented by arrow 460, which may be generated by center tap noise of the transformer 410 or a transformer windings imbalance. Moreover, this cable side 452 location may allow the ferrite component 220 to filter the noise in systems where the chassis ground is connected to a digital ground, which is sometimes noisy enough to inject noise through a high voltage capacitor.

Still referring to FIG. 12, a ferrite component 220 disposed on the cable side 452 allows the ferrite component 220 to be installed or included in a connector 200 without requiring any other dimensions of the modular jack 400 to be expanded or otherwise modified. By comparison, if the ferrite component 220 were disposed on the connections 412 between the transformer 410 and a printed circuit board (PCB) 414, the connections 412 may need to be extended to still allow the modular jack 400 to be coupled to the PCB 414. In other words, installing the ferrite component 220 on a chip side 454 of the modular jack 400 may require length modifications of the connections 412 to provide extra space for the ferrite component. This may be especially true when PCB 414 has a thickness of more than 100 mil, many of which are frequently used with various electrical products. Furthermore, installing the ferrite component on the cable side 452, as opposed to the chip side 454, may also provide power advantages. For example, if the physical layer processing portion (PHYs) of a PCB 414 use a center tap as a source of power for transmitting, a common mode choke generally cannot be implemented on the chip side, as it may lead to supply voltage sags and prevent proper functioning. By comparison, providing a common mode choke on the cable side does not have this problem, as illustrated by the freely flowing arrows 470 shown in circuitry representation 450.

Although FIG. 12 is shown with a connector 200 that includes two sets of spring pins, it is to be understood that the advantages described above with regards to FIG. 12 may also be provided with connectors that only include a single set of pins, such as connectors 100 and 300. In other words, any connector including a ferrite component disposed around a base portion of spring pins, regardless of the amount of spring pins or the manner in which the ferrite component receives the spring pins (e.g., with or without an insert) may provide EMI suppression of noise generated from modular jack components, such as a transformer, in the manner described above with regards to connector 200 included in modular jack 400 of FIG. 12. Moreover, any such connector may also filter noise from a cable, as the connector will be disposed at the entry point of the modular jack and, thus, be able to filter noise entering the jack before it reaches any components of the modular jack.

Figure 13:
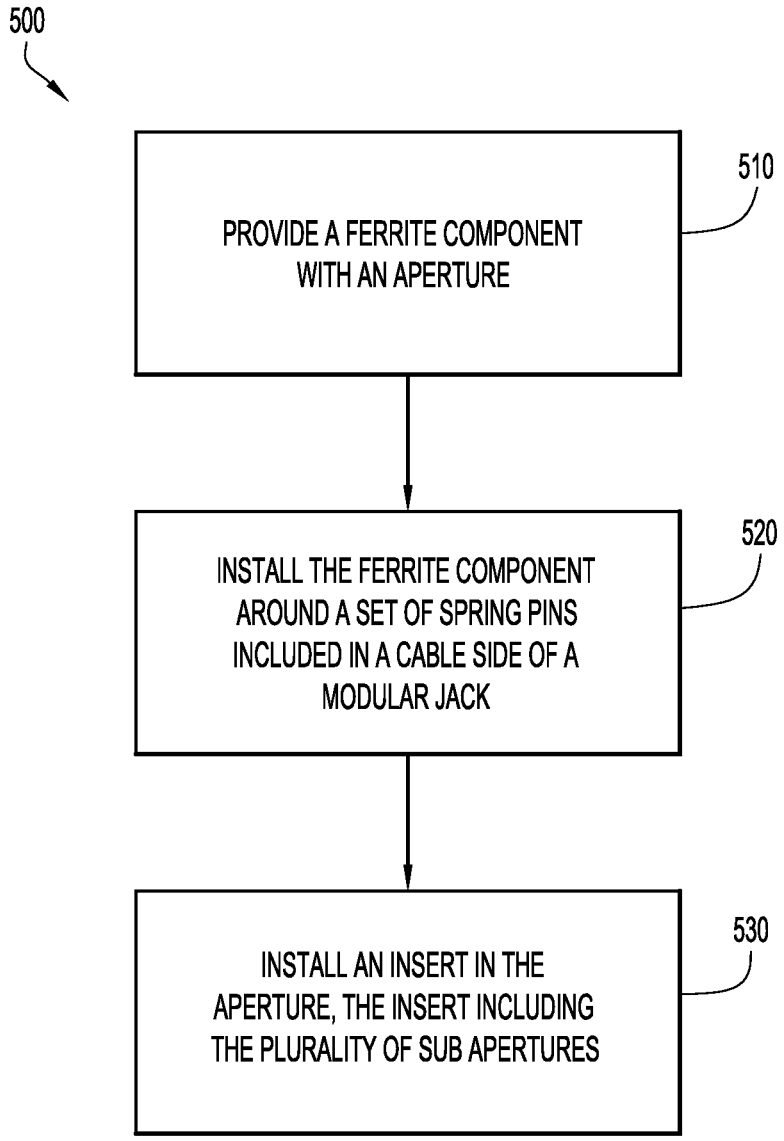
FIG. 13 is a flow chart illustrating a method of suppressing EMI with a modular connector according to an example embodiment.

Now turning to FIG. 13, a flow chart 500 for an example method of suppressing EMI in accordance with an example embodiment is shown. Initially, at step 510, a ferrite component, such as the ferrite components 120, 220, and 320 shown in FIGS. 1-12 and described above, is provided. At step 520, the ferrite component is installed around of spring pins included in a cable side of a modular jack. As described above, in some embodiments, the ferrite component may include subapertures configured to receive each spring pin included in the set of spring pins individually while other embodiments may include a single aperture configured to receive all of the spring pins included in the set of spring pins. Additionally or alternatively, the ferrite component may surround a substrate that the spring pins are mounted to, mount the spring pins to a substrate, and/or surround a connector that is coupling the set of spring pins to a substrate. In some embodiments, such as those in which the ferrite component only includes a single aperture that receives all of the spring pins included in the set of spring pins, an insert may be installed in the aperture of the ferrite component at step 530 in order to provide subapertures to individually receive each of the spring pins included in the set of spring pins.

Modular connectors in accordance with examples presented herein may provide a number of advantages over conventional connectors or other manners of suppressing EMI. Most notably, the modular connectors of the examples presented herein provide noise suppression, as is represented by improvements in at least some of the Scattering parameters (S-parameters) of a connector with a ferrite component as described herein as compared to a connector without a ferrite component. For example, as compared to connector without a ferrite component, the input differential insertion loss (SDD21) of a connector with a ferrite component according to exampled described herein is almost kept the same, so there is no impact on the useful signal and input common insertion loss (SCC21) is reduced by 20-30 dB at interest frequency, such as several hundred MHz, so noise in this frequency range is mitigated by the ferrite ring. Moreover, modular connectors in accordance with the examples presented herein can reduce total radiated power (TRP) which go out through a modular jack by 10-20 dB. Consequently, modular connectors in accordance with examples presented herein may improve emission and immunity.

Still further, modular connectors in accordance with examples presented herein are also advantageous because they provide EMI noise suppression and TRP reduction without an extra space requirement at least due to being disposed around the base portions of the spring pins on the cable side of a connector. This position also saves cost and PCB space by allowing any components commonly used to filter noise in a modular jack, such as any capacitors, inductors, and common mode chokes, to be removed from or not included in a modular jack. Moreover, at least because the modular connectors in accordance with examples presented herein can filter incoming noise from a cable inserted therein, the modular connectors may also be used with unshielded twisted cable, which may reduce overall system costs and remove the need for users to install expensive modifications onto cables that occupy space and are difficult to install. In other words, modular connectors in accordance with examples presented herein provide compatibility with a wide variety of cables while still reducing noise. Similarly, present embodiments do not require modular jacks to be modified in order to include connectors described herein.

In one form, an apparatus is provided comprising a substrate; at least one set of spring pins, each spring pin included in the at least one set of spring pins including a first portion adjacent the substrate and a second portion extending away from the substrate; and a ferrite component surrounding the at least one set of spring pins, coupling the at least one set of spring pins to the substrate, and configured to suppress electromagnetic interference.

In another form, a system is provided comprising: a modular jack including at least one set of spring pins, and the modular jack including a cable side configured to receive a cable; and a ferrite component configured to be installed around the spring pins, wherein the ferrite component is installed on the cable side of the modular jack and is configured to suppress electromagnetic noise generated by a transformer included in the modular jack and electromagnetic noise from the cable.

In still another form, a method of suppressing electromagnetic interference in a modular jack is provided comprising providing a ferrite component; installing the ferrite component around a set of spring pins included in a cell of a modular jack, wherein the ferrite component is installed on a cable side of the modular jack, and wherein, when installed, the ferrite component is configured to suppress electromagnetic noise generated by a transformer included in the modular jack and electromagnetic noise from a cable that is coupled to the modular jack.

Although the techniques are illustrated and described herein as embodied in one or more specific examples, it is nevertheless not intended to be limited to the details shown, since various modifications and structural changes may be made within the scope and range of the claims.

What is claimed is:

1. A modular connector comprising:

a substrate;

at least one set of spring pins, each spring pin included in the at least one set of spring pins including a first portion adjacent the substrate and a second portion extending away from the substrate; and a ferrite component extending between the set of spring pins and the substrate, surrounding the first portion of the at least one set of spring pins, coupling the at least one set of spring pins to the substrate, and configured to suppress electromagnetic interference.

2. The modular connector of claim 1, wherein the ferrite component further comprises:

an annular wall with an aperture configured to receive all of the spring pins included in the at least one set of spring pins.

3. The modular connector of claim 2, wherein the ferrite component further comprises:

a plurality of subapertures, each subaperture configured to receive a single pin of the at least one set of spring pins.

4. The modular connector of claim 3, wherein the ferrite component further comprises:

a plastic insert extending within the aperture, the plastic insert including the subapertures.

5. The modular connector of claim 1, wherein the at least one set of spring pins comprises:

a first set of spring pins disposed adjacent to and extending away from a first surface of the substrate; and a second set of spring pins disposed adjacent to and extend away from a second surface of the substrate, the second surface being opposite the first surface.

6. The modular connector of claim 5, wherein the ferrite component further comprises:

an annular wall with an aperture configured to receive all of the spring pins included in the first set of spring pins and the second set of spring pins.

7. The modular connector of claim 1, wherein the relative permeability of the ferrite component is approximately 1000.

8. The modular connector of claim 1, wherein the modular connector is suitable for stacked or single port connectors.

9. A system comprising:

a modular jack including at least one set of spring pins, a transformer, and a cable side configured to receive a cable; and a ferrite component configured to be installed around the spring pins, wherein the ferrite component is installed on the cable side of the modular jack and is configured to suppress electromagnetic noise generated by the transformer and electromagnetic noise from the cable.

10. The system of claim 9, wherein the ferrite component reduces a total radiated power that can exit the modular jack.

11. The system of claim 10, wherein the total radiated power is reduced by approximately 10-20 dB.

12. The system of claim 9, wherein the ferrite component suppresses electromagnetic noise without reducing supply voltage.

13. The system of claim 9, wherein the ferrite component further comprises:

an annular wall with an aperture configured to receive all of the spring pins included in the at least one set of spring pins; and a plurality of subapertures disposed within the aperture, each subaperture configured to receive a single pin of the at least one set of spring pins.

14. The system of claim 13, wherein the ferrite component further comprises:

a non-ferrite insert disposed within and extending across the aperture, the plurality of subapertures being formed in the insert.

15. The system of claim 9, wherein the modular jack includes two sets of pins coupled to opposing planar surfaces of a substrate and the ferrite component is installed around both of the two sets of pins.

16. The system of claim 15, wherein the two sets of pins each include a plurality of pins, each pin having a base portion and a spring portion, the ferrite component being installed around the base portion of each of the pins.

17. A method of suppressing electromagnetic interference in a modular jack, comprising:

providing a ferrite component; and installing the ferrite component around a set of spring pins included in a cell of a modular jack, wherein each spring pin in the set of spring pins includes a base portion coupled to a substrate and the ferrite component is installed on a cable side of the modular jack around the base portion of each of the spring pins and the substrate, and wherein, when installed, the ferrite component is configured to suppress electromagnetic noise generated by a transformer included in the modular jack and electromagnetic noise from a cable that is coupled to the modular jack.

18. The method of claim 17, wherein the ferrite component comprises:

an annular wall with an aperture configured to receive all of the spring pins included in the at least one set of spring pins; and a plurality of subapertures disposed within the aperture, each subaperture in the plurality of subapertures being configured to receive a single pin of the at least one set of spring pins.

19. The method of claim 18, wherein the method further comprises:

installing a non-ferrite insert in the aperture, the non-ferrite insert including the plurality of subapertures.

* * * * *